US012116796B2

(12) United States Patent
Deng

(10) Patent No.: US 12,116,796 B2
(45) Date of Patent: Oct. 15, 2024

(54) ROTATING STRUCTURE AND TENT ASSEMBLY

(71) Applicant: EAGLE OUTDOOR CAMPING PRODUCTS CO., LTD., Quzhou (CN)

(72) Inventor: Lidan Deng, Quzhou (CN)

(73) Assignee: EAGLE OUTDOOR CAMPING PRODUCTS CO., LTD., Quzhou (CN)

( * ) Notice: Subject to any disclaimer, the term of this patent is extended or adjusted under 35 U.S.C. 154(b) by 144 days.

(21) Appl. No.: 18/051,302

(22) Filed: Oct. 31, 2022

(65) Prior Publication Data

US 2024/0052671 A1 Feb. 15, 2024

(30) Foreign Application Priority Data

Aug. 11, 2022 (CN) ..... 202222117249.3

(51) Int. Cl.
*E04H 15/06* (2006.01)
*E04H 15/46* (2006.01)

(52) U.S. Cl.
CPC ..... *E04H 15/46* (2013.01); *E04H 15/06* (2013.01)

(58) Field of Classification Search
CPC ..... A45B 2023/0025; A45B 2023/0027
See application file for complete search history.

(56) References Cited

U.S. PATENT DOCUMENTS

| | | | | |
|---|---|---|---|---|
| 4,566,475 | A * | 1/1986 | Wund | E04H 3/165 52/65 |
| 4,836,232 | A * | 6/1989 | De Rosa | A45B 19/04 135/147 |
| 9,915,080 | B2 * | 3/2018 | Finck | B60P 3/343 |
| 11,149,463 | B2 * | 10/2021 | Pearce | B60J 7/12 |
| 2011/0030744 | A1 * | 2/2011 | Yun | A45B 23/00 135/20.1 |
| 2020/0141151 | A1 * | 5/2020 | Everett | E04F 10/04 |

FOREIGN PATENT DOCUMENTS

| | | | | |
|---|---|---|---|---|
| CN | 213063152 U | | 4/2021 | |
| WO | WO-2004099528 | A1 * | 11/2004 | B60J 11/00 |
| WO | WO-2017032828 | A1 * | 3/2017 | E04F 10/04 |

* cited by examiner

*Primary Examiner* — Noah Chandler Hawk
(74) *Attorney, Agent, or Firm* — Schwegman Lundberg & Woessner, P.A.

(57) ABSTRACT

A rotating structure and a tent assembly are provided. The rotating structure includes a shaft; a first rotor rotatably sleeved outside the shaft; a second rotor rotatably sleeved outside the shaft; a first extension connected with the first rotor, the first extension being rotatably sleeved outside the second rotor and the shaft; a second extension connected with the second rotor, the second extension being rotatably sleeved outside the first rotor and the shaft; a first axial limiter being in contact with the first extension away from the second extension; and a second axial limiter being in contact with the second extension away from the first extension. In view of a technical problem that a car folding tent is large in volume after being stored, the disclosure provides technical effect that it can make a volume of the stored tent small on a premise of ensuring good rotating stability.

12 Claims, 2 Drawing Sheets

ROTATING STRUCTURE AND TENT ASSEMBLY

CROSS REFERENCE TO RELATED APPLICATION

This Non-provisional application claims priority under 35 U.S.C. § 119(a) to Chinese Patent Application No. 202222117249.3, filed on 11 Aug. 2022, the entire contents of which is hereby incorporated by reference in its entirety.

TECHNICAL FIELD

The disclosure relates to the technical field of tents, in particular to a rotating structure and a tent assembly.

BACKGROUND ART

A tent is a type of shed which is supported on the ground to shelter from wind, rain and sunlight and is used for temporary residence. It has advantages of convenient disassembly and assembly, convenient storage, etc., and has been widely used in fields such as field construction, camping training, temporary clubs or the like.

A car tent is a common kind of tent, and related car tents are generally unfolded and stored by rotation. However, due to a short axial distance at a rotating position, rotation stability is poor. A car folding tent is disclosed in Chinese utility patent No. CN213063152U issued on Apr. 27, 2021, which includes a supporting framework and a tarpaulin arranged on the supporting framework. The supporting framework includes a fixed seat and a plurality of brackets rotatably arranged on the fixed seat, and the plurality of brackets rotate in a same direction around the fixed seat to enable the tarpaulin to unfold or fold in a fan shape. For the car folding tent in this disclosure, erection and folding of the car tent can be quickly realized, without detaching the tarpaulin and the supporting framework when the tarpaulin is fold, which is simple and convenient to use and save time. The fixed seat is provided with an accommodating groove. When the tarpaulin is in a folded state, an end of the bracket is accommodated in the accommodating groove, so that the folded tent is small in volume, convenient to carry and use with a car, convenient for logistics transportation and storage, and facilitates popularization and application. Moreover, the axial distance at a respective rotating position is long, thus rotation stability is good, but with a disadvantage that the car folding tent is still large in volume after being stored due to four staggered rotating positions.

SUMMARY

In view of a technical problem that a car folding tent is large in volume after being stored, a rotating structure and a tent assembly are provided in the disclosure, which can make a volume of the stored tent small on a premise of ensuring good rotating stability.

To solve the above problems, the technical scheme provided in the disclosure is as follows:

A rotating structure includes a shaft, a first rotor, a second rotor, a first extension, a second extension, a first axial limiter and a second axial limiter.

The first rotor is rotatably sleeved outside the shaft.

The second rotor is rotatably sleeved outside the shaft.

The first extension is connected with the first rotor, and the first extension is rotatably sleeved outside the second rotor and the shaft.

The second extension is connected with the second rotor, and the second extension is rotatably sleeved outside the first rotor and the shaft.

The first axial limiter is in contact with the first extension away from the second extension.

The second axial limiter is in contact with the second extension away from the first extension.

Optionally, the first rotor is provided with a first channel, and the second rotor is provided with a second channel, and both the first channel and the second channel are matched with the shaft.

Optionally, the first extension includes a first plate-shaped member and a first matching member.

The first plate-shaped member is connected with the first rotor.

The first matching member is connected with an end of the first plate-shaped member away from the first rotor, and the first fitting member is provided with a first through hole.

The first plate-shaped member is sleeved outside the second rotor, and the first through hole is matched with the shaft.

Optionally, the second extension includes a second plate-shaped member and a second matching member.

The second plate-shaped member is connected with the second rotor.

The second matching member is connected with an end of the second plate-shaped member away from the second rotor, and the second fitting member is provided with a second through hole.

The second plate-shaped member is sleeved outside the first rotor, and the second through hole is matched with the shaft.

Optional, the rotating structure further includes a first tubular body, a second tubular body, a first link and a second link.

The first tubular body is connected with the first rotor.

The second tubular body is connected with the second rotor.

The first link is detachably connected with the first tubular body.

The second link is detachably connected with the second tubular body.

Optionally, the first link is sleeved inside or outside the first tubular body, and the second link is sleeved inside or outside the second tubular body.

A tent assembly includes a rotating structure and further includes a mounting seat and a canvas curtain.

The shaft is connected to the mounting seat, the first axial limiter is located at a side of the mounting seat away from the first extension, and the second axial limiter is located at a side of the mounting seat away from the second extension.

The canvas curtain is connected with both the first rotor and the second rotor.

Optionally, the tent assembly further includes a base connected with the mounting seat, and the base is configured for connecting to a vehicle.

Optionally, the canvas curtain is connected with both the first link and the second link.

Optionally, connection between the mounting seat and the base is detachable connection.

Compared with related art, technical schemes according to the disclosure has following beneficial effects. The shaft is configured for bearing the first rotor, the second rotor and the first extension or the like. The first rotor is configured for matching with the shaft, and the first extension is configured for increasing an axial length of the first rotor, thereby increasing rotational stability of the first rotor. The second rotor is configured for matching with the shaft, and the second extension is configured for increasing an axial length of the second rotor, thereby increasing rotational stability of the second rotor. Because the first extension is rotatably sleeved outside the second rotor and the shaft and the second extension is rotatably sleeved outside the first rotor and the shaft, the first rotor and the second rotor share a same shaft, thereby effectively reducing a volume of the stored rotating structure. The first axial limiter is configured for limiting axial displacement of the first extension, thereby limiting axial displacement of the first rotor; and the second axial limiter is configured for limiting axial displacement of the second extension, thereby limiting axial displacement of the second rotor. To sum up, with the rotating structure according to the disclosure, the volume after storage can be effectively reduced on a premise of ensuring rotating stability of the first rotor and the second rotor.

Figure 1:
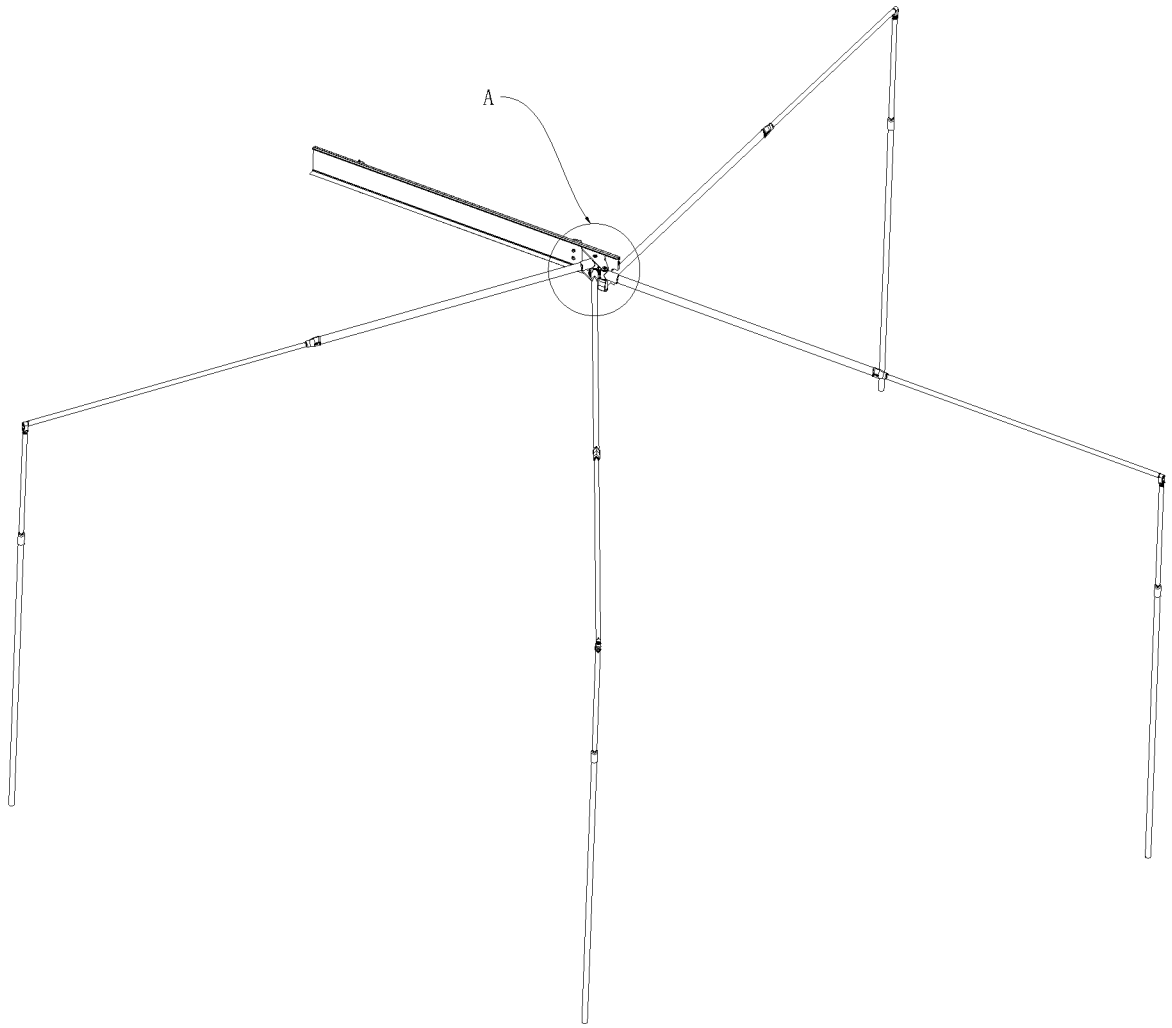
FIG. 1 is a structural schematic diagram of a tent assembly according to an embodiment of the disclosure.

Reference numbers in the figures are as follows: 1. Shaft; 2. First Rotor; 21. First Channel; 3. Second Rotor; 31. Second Channel; 4. First Extension; 41. First Plate-shaped Member; 42. First Matching Member; 421. First Through Hole; 5. Second Extension; 51. Second Plate-shaped Member; 52. Second Matching Member; 521. Second Through Hole; 6. First Axial limiter; 7. Second Axial Limiter; 8. First Tubular Body; 9. Second Tubular Body; 100. First Link; 110. Second Link; 120. Mounting Seat; 130. Base.

DETAILED DESCRIPTION

In order to further understand contents of the present disclosure, the present disclosure will be described in detail with reference to drawings and examples.

The application will be further described in detail with reference to the drawings and embodiments. It can be understood that the specific embodiments described herein are only intended to explain related disclosures, but not to limit the disclosure. In addition, it should also be noted that for convenience of description, only the parts related to the disclosure are shown in the drawings. Terms such as "first" and "second" mentioned in the present disclosure are provided for convenience of describing the technical scheme of the present disclosure, have no specific limiting function, are all general terms and do not constitute a limiting for the technical scheme of the present disclosure. It should be noted that the embodiments in the present application and the characteristics in the embodiments can be combined mutually in the case of no conflict. In the description of the present disclosure, it should be understood that the terms "center", "upper", "lower", "left", "right", "vertical", "horizontal", "inner" and "outer" which indicate an orientation or positional relationship are based on the orientation or positional relationship shown in the drawings, and are merely for convenience of describing the present disclosure and simplifying the description, rather than indicate or imply that the device or element referred to must have a specific orientation, be configured and operated in a specific orientation, and thus cannot be understood as a limitation on the present disclosure. In addition, the terms "first", "second" and "third" are only configured for descriptive purposes and cannot be understood as indicating or implying a relative importance. Unless otherwise specified and limited, the terms "installing", "coupling" and "connecting" should be understood in a broad sense, for example, it can be "fixedly connecting", or "detachably connecting" or "integrally connecting", or it can be "mechanically connecting" or "electrically connecting", or it can be "directly connecting" or "indirectly connecting through an intermediate medium", or it can be "communicating within two elements". For a person of ordinary skill in the art, specific meanings of the above terms in the present disclosure can be understood according to specific situations. A plurality of technical solutions in a same embodiment as well as a plurality of technical solutions in different embodiments can be arranged and combined to form a new technical solution without contradictions or conflicts, all of which are within a claimed scope of the present disclosure.

Embodiment 1

Figure 2:
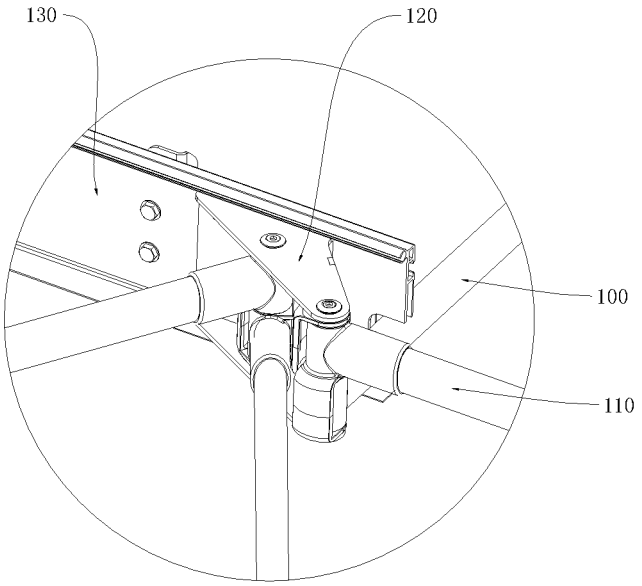
FIG. 2 is a structural schematic diagram of A according to an embodiment of the disclosure.
Figure 3:
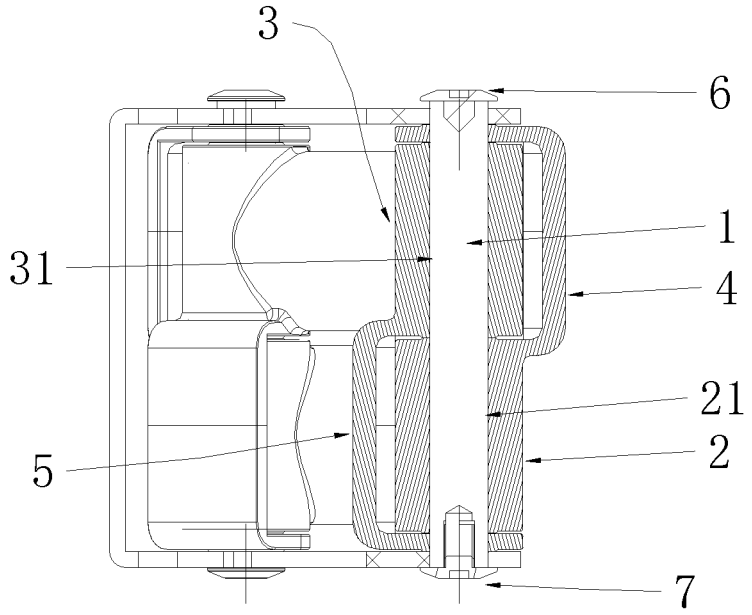
FIG. 3 is a schematic diagram of a rotating structure according to an embodiment of the disclosure.
Figure 4:
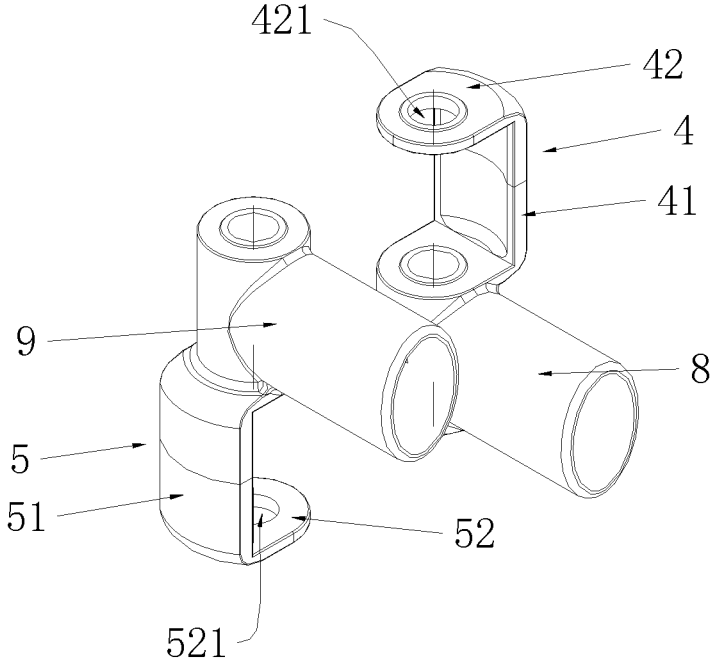
FIG. 4 is another schematic diagram of a rotating structure according to an embodiment of the disclosure.

With reference to FIGS. 1 to 4, a rotating structure is provided in this embodiment, which includes a shaft 1, a first rotor 2, a second rotor 3, a first extension 4, a second extension 5, a first axial limiter 6 and a second axial limiter 7.

The first rotor 2 is rotatably sleeved outside the shaft 1.

The second rotor 3 is rotatably sleeved outside the shaft 1.

The first extension 4 is connected with the first rotor 2, and the first extension 4 is rotatably sleeved outside the second rotor 3 and the shaft 1.

The second extension 5 is connected with the second rotor 3, and the second extension 5 is rotatably sleeved outside the first rotor 2 and the shaft 1.

The first axial limiter 6 is in contact with the first extension 4 away from the second extension 5.

The second axial limiter 7 is in contact with the second extension 5 away from the first extension 4.

Specifically, the shaft 1 is configured for bearing the first rotor 2, the second rotor 3 and the first extension 4 or the like. The first rotor 2 is configured for matching with the shaft 1, and the first extension 4 is configured for increasing an axial length of the first rotor 2, thereby increasing rotational stability of the first rotor 2. The first rotor 2 specifically can be a cylindrical body, a rod-shaped body or the like with a channel and the first extension 4 specifically can be a plate-shaped body or a block-shaped body with a C-shaped cross section. The second rotor 3 is configured for matching with the shaft 1, and the second extension 5 is configured for increasing an axial length of the second rotor 3, thereby increasing rotational stability of the second rotor 3. The second rotor 3 specifically can be a cylindrical body, a rod-shaped body or the like with a channel and the second extension 5 specifically can be a plate-shaped body or a block-shaped body with a C-shaped cross section. Because the first extension 4 is rotatably sleeved outside the second rotor 3 and the shaft 1 and the second extension 5 is rotatably sleeved outside the first rotor 2 and the shaft 1, the first rotor 2 and the second rotor 3 share a same shaft 1, thereby effectively reducing a volume of the stored rotating structure. The first axial limiter 6 is configured for limiting axial displacement of the first extension 4, thereby limiting axial displacement of the first rotor 2; and the second axial limiter 7 is configured for limiting axial displacement of the second extension 5, thereby limiting axial displacement of the second rotor 3. The first axial limiter 6 and the second axial limiter 7 can be pan-head screws, cylinder screws or the etc. To sum up, with the rotating structure according to the disclosure, the volume after storage can be effectively reduced on a premise of ensuring rotating stability of the first rotor 2 and the second rotor 3.

Furthermore, the first rotor 2 is provided with a first channel 21, and the second rotor 3 is provided with a second channel 31, and both the first channel 21 and the second channel 31 are matched with the shaft 1.

Specifically, the first channel 21 is supported by the first rotor 2, and is configured to cooperate with the shaft 1, thus functioning to radially limit the first rotor 2 and further ensuring rotation stability of the first rotor 2. The second channel 31 is supported by the second rotor 3 and is configured to cooperate with the shaft 1, thus functioning to radially limit the second rotor 3 and further ensuring rotation stability of the second rotor 3. At the same time, since both the first channel 21 and the second channel 31 cooperate with the shaft 1, the first channel 21 and the second channel 31 share the same shaft 1, thus effectively reducing the volume of the stored rotating structure. Cross-sections of the first channel 21 and the second channel 31 can be circular, oval, etc.

Further, the first extension 4 includes a first plate-shaped member 41 and a first matching member 42.

The first plate-shaped member 41 is connected with the first rotor 2.

The first matching member 42 is connected with an end of the first plate-shaped member 41 away from the first rotor 2, and the first fitting member 42 is provided with a first through hole 421.

The first plate-shaped member 41 is sleeved outside the second rotor 3, and the first through hole 421 is matched with the shaft 1.

Specifically, the first plate-shaped member 41 is supported by the first rotor 2 and provides enough rotating space for the second rotor 3. The first matching member 42 is supported by the first plate-shaped member 41, and is configured for supporting the first through hole 421. Because the first through hole 421 is matched with the shaft 1, which facilitates radial limiting on the first matching member 42 and also facilitates sharing of the shaft 1 by the first through hole 421 and the second extension 5, thus effectively reducing the volume of the stored rotating structure. Cross section of the first plate-shaped member 41 specifically can be rectangular, trapezoidal, etc., cross section of the first matching member 42 specifically can be circular, fan-shaped, etc., and cross section of the first through hole 421 specifically can be circular, oval, etc.

Further, the second extension 5 includes a second plate-shaped member 51 and a second matching member 52.

The second plate-shaped member 51 is connected with the second rotor 3.

The second matching member 52 is connected with an end of the second plate-shaped member 51 away from the second rotor 3, and the second fitting member 52 is provided with a second through hole 521.

The second plate 51 is sleeved outside the first rotor 2, and the second through hole 521 is matched with the shaft 1.

Specifically, the second plate-shaped member 51 is supported by the second rotor 3 and provides enough rotating space for the first rotor 2. The second matching member 52 is supported by the second plate-shaped member 51, and is configured for supporting the second through hole 521. Because the second through hole 521 is matched with the shaft 1, which facilitates radial limiting on the second matching member 52 and also facilitates sharing of the shaft 1 by the first extension 4 and the second through hole 521, thus effectively reducing the volume of the stored rotating structure. Cross section of the second plate-shaped member 51 can be rectangular, trapezoidal, etc., and cross section of the second matching member 52 specifically can be circular, fan-shaped, etc., and cross section of the second through hole 521 specifically can be circular, oval, etc.

Further, it further includes first tubular body 8, a second tubular body 9, a first link 100 and a second link 110.

The first tubular body 8 is connected with the first rotor 2.

The second tubular body 9 is connected with the second rotor 3.

The first link 100 is detachably connected with the first tubular body 8.

The second link 110 is detachably connected with the second tubular body 9.

Specifically, the first tubular body 8 is configured to connect the first rotor 2 and the first link 100. Cross section of the first tubular body 8 specifically can be circular, rectangular, etc. The second tubular body 9 is configured to connect the second rotor 3 and the second link 110. Cross section of the second tubular body 9 can be circular, rectangular, etc. With the detachable connection, disassembling of the first tubular body 8 and the first link 100 and disassembling of the second tubular body 9 and the second link 110 can be facilitated. Cross sections of the first link 100 and the second link 110 specifically can be circular, rectangular, etc.

Further, the first link 100 is sleeved inside or outside the first tubular body 8, and the second link 110 is sleeved inside or outside the second tubular body 9.

Specifically, sleeving can increase contact area between the first link 100 and the first tubular body 8 and contact area between the second link 110 and the second tubular body 9, thus increasing connection stability between the first link 100 and the first tubular body 8 and connection stability between the second link 110 and the second tubular body 9.

Embodiment 2

With reference to FIGS. 1-4, a tent assembly is provided in this embodiment, which includes a rotating structure and further includes a mounting seat 120 and a canvas curtain.

The shaft 1 is connected to the mounting seat 120, the first axial limiter 6 is located at a side of the mounting seat 120 away from the first extension 4, and the second axial limiter 7 is located at a side of the mounting seat 120 away from the second extension 5.

The canvas curtain is connected with both the first rotor 2 and the second rotor 3.

Specifically, when the rotating structure is applied to the tent assembly, two rotating structures can be arranged, that is, there are four rotating points, but only two of them are required to be staggered instead of all of them, thus reducing a volume of the stored tent assembly to a certain extent. The mounting seat 120 is configured to mount the shaft 1, and the mounting seat 120 specifically can be a box-shaped member, a tank-shaped member, etc. The canvas curtain is supported by first rotor 2 and second rotor 3, and is configured to shield wind, rain, sunlight, etc. Material of the canvas curtain can be nylon, Oxford cloth, etc.

Further, the tent assembly further includes a base 130 connected with the mounting seat 120, and the base 130 is configured to connect to a vehicle.

Specifically, the base 130 is configured to support the mounting seat 120 and connect to the vehicle, thus facilitating connection of the tent assembly to the vehicle to become a car tent assembly. The base 130 specifically can be a box-shaped member, a box-shaped member or the like with a mounting hole.

Further, the canvas curtain is connected with both the first link 100 and the second link 110.

Specifically, the canvas curtain is supported by the first link 100 and the second link 110, and is configured to shield the wind, rain, sunlight and the like.

Further, connection between the mounting seat 120 and the base 130 is detachable connection.

Specifically, disassembling of the mounting seat 120 and the base 130 can be facilitated, thus facilitating timely replacement or maintenance of the mounting seat 120 and the base 130.

The present disclosure and embodiments thereof are described above in an illustrative manner, which is not restrictive; and what is shown in the drawings is only one of the embodiments of the present disclosure, and its actual structure is not limited thereto. Therefore, structures and embodiments similar to the technical scheme designed by those of ordinary skills in the art inspired by this disclosure without creativity, without departing from the creative purpose of the present disclosure, are all within a protection scope of the present disclosure.

What is claimed is:

1. A rotating structure, comprising:

a shaft;

a first rotor rotatably sleeved outside the shaft;

a second rotor rotatably sleeved outside the shaft;

a first extension connected with the first rotor, the first extension being rotatably sleeved outside the second rotor and the shaft;

a second extension connected with the second rotor, the second extension being rotatably sleeved outside the first rotor and the shaft;

a first axial limiter being connected with the first extension away from the second extension; and a second axial limiter being connected with the second extension away from the first extension;

wherein the first extension comprises:

a first plate-shaped member connected with the first rotor; and a first matching member connected with an end of the first plate-shaped member away from the first rotor, the first fitting member being provided with a first through hole;

wherein the first plate-shaped member is sleeved outside the second rotor, and the first through hole is matched with the shaft.

2. The rotating structure according to claim 1, wherein the first rotor is provided with a first channel, and the second rotor is provided with a second channel, and both the first channel and the second channel are matched with the shaft.

3. The rotating structure according to claim 1, wherein the second extension comprises:

a second plate-shaped member connected with the second rotor; and a second matching member connected with an end of the second plate-shaped member away from the second rotor, the second fitting member being provided with a second through hole;

wherein the second plate-shaped member is sleeved outside the first rotor, and the second through hole is matched with the shaft.

4. The rotating structure according to claim 1, further comprising:

a first tubular body connected with the first rotor;

a second tubular body connected with the second rotor;

a first link detachably connected with the first tubular body; and a second link detachably connected with the second tubular body.

5. The rotating structure according to claim 4, wherein the first link is sleeved inside or outside the first tubular body, and the second link is sleeved inside or outside the second tubular body.

6. A tent assembly comprising the rotating structure according to claim 1, further comprising:

a mounting seat to which the shaft is connected, the first axial limiter being located at a side of the mounting seat away from the first extension, and the second axial limiter being located at a side of the mounting seat away from the second extension; and a canvas curtain connected with both the first rotor and the second rotor.

7. The tent assembly according to claim 6, further comprising a base connected with the mounting seat, the base being configured for connecting to a vehicle.

8. The tent assembly according to claim 7, wherein connection between the mounting seat and the base is detachable connection.

9. The tent assembly according to claim 6, wherein the first rotor is provided with a first channel, and the second rotor is provided with a second channel, and both the first channel and the second channel are matched with the shaft.

10. The tent assembly according to claim 6, wherein the second extension comprises:

a second plate-shaped member connected with the second rotor; and a second matching member connected with an end of the second plate-shaped member away from the second rotor, the second fitting member being provided with a second through hole;

wherein the second plate-shaped member is sleeved outside the first rotor, and the second through hole is matched with the shaft.

11. The tent assembly according to claim 6, further comprising:

a first tubular body connected with the first rotor;

a second tubular body connected with the second rotor;

a first link detachably connected with the first tubular body; and a second link detachably connected with the second tubular body.

12. The tent assembly according to claim 11, wherein the first link is sleeved inside or outside the first tubular body, and the second link is sleeved inside or outside the second tubular body.

* * * * *